US006336821B1

(12) United States Patent
Hattori

(10) Patent No.: US 6,336,821 B1
(45) Date of Patent: Jan. 8, 2002

(54) CONNECTOR FOR USE IN SOLAR GENERATOR

(75) Inventor: Yutaka Hattori, Osaka (JP)

(73) Assignee: Kitani Electric Co., Ltd., Osaka (JP)

( * ) Notice: Subject to any disclaimer, the term of this patent is extended or adjusted under 35 U.S.C. 154(b) by 0 days.

(21) Appl. No.: 09/577,950

(22) Filed: May 25, 2000

(30) Foreign Application Priority Data

May 26, 1999 (JP) ..... 11-003648
Jul. 8, 1999 (JP) ..... 11-005093

(51) Int. Cl.[7] ..... H01R 13/52
(52) U.S. Cl. ..... 439/282
(58) Field of Search ..... 439/281, 282, 439/283, 350, 693, 825, 827

(56) References Cited

U.S. PATENT DOCUMENTS 2,716,737 A * 8/1955 Maberry
3,124,405 A * 3/1964 Massa
3,611,255 A * 10/1971 Shroyer ..... 339/60
3,880,487 A * 4/1975 Goodman et al. ..... 339/60
4,468,083 A * 8/1984 Lee et al. ..... 339/252
4,973,266 A * 11/1990 Bullard ..... 439/589
5,015,195 A * 5/1991 Piriz ..... 439/318
5,026,301 A * 6/1991 Balyasny et al. ..... 439/391
5,449,304 A * 9/1995 Huss, Jr. et al. ..... 439/843

* cited by examiner

*Primary Examiner*—Brian Sircus
*Assistant Examiner*—Thanh-Tam Le
(74) *Attorney, Agent, or Firm*—Wenderoth, Lind & Ponack, L.L.P.

(57) ABSTRACT

A connector which shows strong connecting force includes rod-shaped male and female terminals that are coaxially inserted in respective tubular insulating resin housings. The male terminal is inserted into the female terminal so as to be electrically coupled to the female terminal. The female housing has outer and inner tubular portions formed with axially corrugated inner and outer surfaces defining an annular groove therebetween. The male housing has an annular tip having axially corrugated inner and outer surfaces adapted to engage the axially corrugated inner and outer surfaces of the female housing when the annular tip is inserted into the annular groove. A potbelly-shaped spring contact member is fitted on the male terminal. Caps are put on the tips of both terminals to prevent a short circuit between the terminals and conductors.

24 Claims, 8 Drawing Sheets

CONNECTOR FOR USE IN SOLAR GENERATOR

BACKGROUND OF THE INVENTION

This invention relates to a connector provided in a line connecting a solar generator (or battery) to an electric device.

As disclosed in e.g. Japanese patent publication 8-222062, an ordinary connector comprises a rod-shaped female terminal and a rod-shaped male terminal inserted coaxially into tubular insulating resin housings, respectively. By inserting the male terminal into the female terminal, they are electrically connected together.

A solar generator generates electricity of about 50 amperes at 900 volts. Connectors used with such a generator have to withstand huge amounts of electricity. Thus, resistance to voltage of about 5000 V or over is required for such connectors. For this purpose, not only the terminals but the housings are required to have a sufficient coupling strength.

An object of the invention is to provide a connector that has a sufficient coupling strength.

SUMMARY OF THE INVENTION

According to this invention, there is provided an electrical connector for use in a solar generator comprising first and second tubular insulating resin housings, a rod-shaped female terminal coaxially inserted in the first housing, and a rod-shaped male terminal inserted in the second housing and adapted to be inserted into the female terminal so as to be electrically connected to the female terminal, the first housing having outer and inner tubular portions formed with axially corrugated inner and outer surfaces, respectively, defining an annular groove therebetween, the second housing having an annular tip having axially corrugated inner and outer surfaces adapted to engage the axially corrugated inner and outer surfaces of the first housing when the second housing is inserted into the first housing so that the annular tip is inserted into the annular groove.

According to the present invention, both of the male and female housings have corrugated surfaces thereon for increased coupling strength.

Also, the contact member having a radially convexed surface is fitted on the male terminal for increased contact pressure with the female terminal.

Because the female housing has a double tube configuration, the coupling force and the water sealability are increased.

According to this invention, a radially outwardly convexed annular contact member is fitted on the male terminal so as to be pressed into close contact with the inner wall of the female terminal for power connection when the male terminal is inserted into the female terminal.

Because the tip of the male terminal is covered with resin, shortcircuiting due to contact with some conductive material is avoided.

The contact member may comprise a plurality of separate radially convexed pieces. This increases the springiness and contact pressure and facilitates manufacture.

The combination of corrugations on the male and female housings with the provision of the contact member increases the coupling strength and contact pressure.

If the male and female housings are made of soft resin or synthetic rubber, the terminals should preferably have their tips covered with hard resin for insulation. This prevents a short circuit even if the soft housing gets bent so that the terminal is exposed.

Other features and objects of the present invention will become apparent from the following description made with reference to the accompanying drawings, in which:

DETAILED DESCRIPTION OF THE PREFERRED EMBODIMENT

Figure 1:
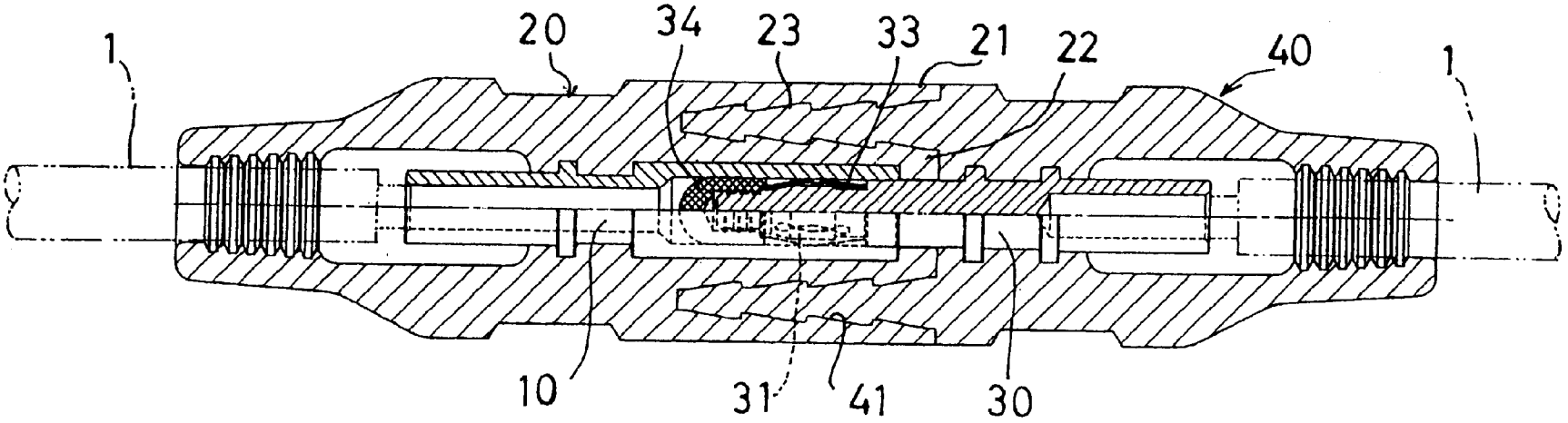
FIG. 1 is a sectional view of a connector embodying the invention.
Figure 2:
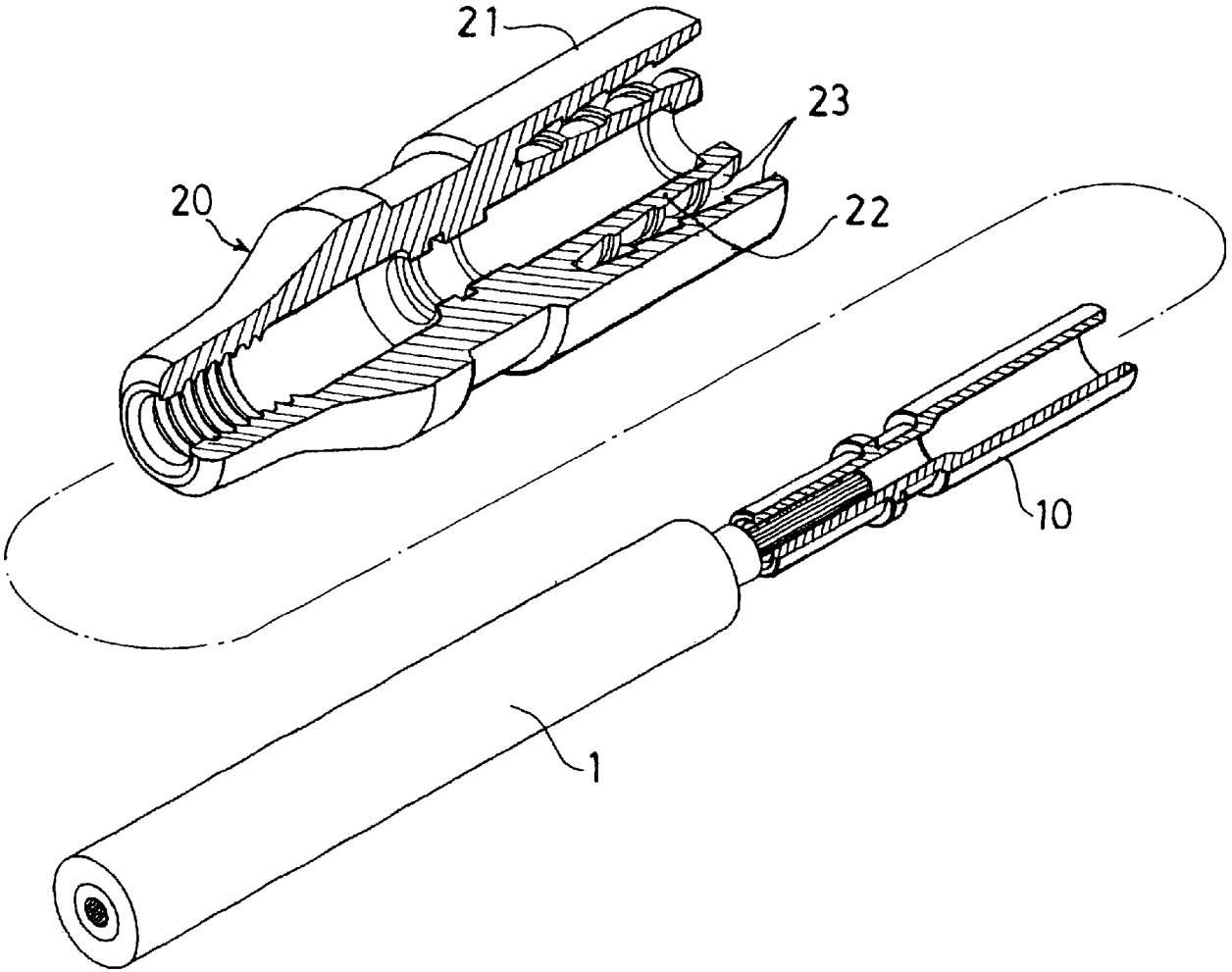
FIG. 2 is a partially cutaway perspective view of a portion of a female terminal of the connector of FIG. 1.
Figure 3:
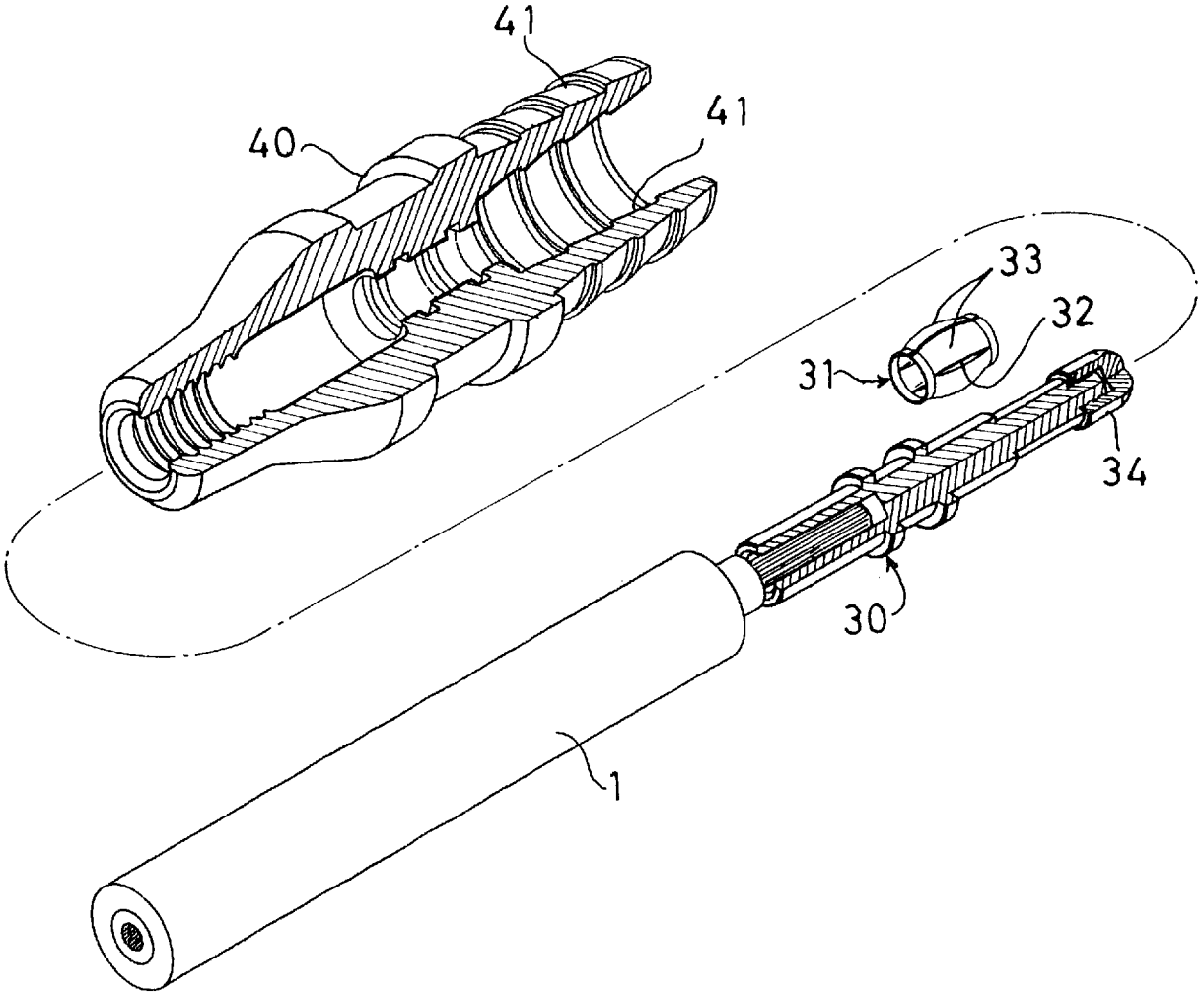
FIG. 3 is a similar view of a portion of a male terminal of the connector of FIG. 1.

FIGS. 1–5 show a connector embodying the present invention. Like conventional connectors, it comprises a rod-shaped female terminal 10 and a rod-shaped male terminal 30 inserted coaxially into tubular insulating housings 20 and 40 made of a soft resin (or rubber), respectively. Power cords 1 are connected to the respective terminals 10 and 30 by inserting and pressing.

Figure 4:
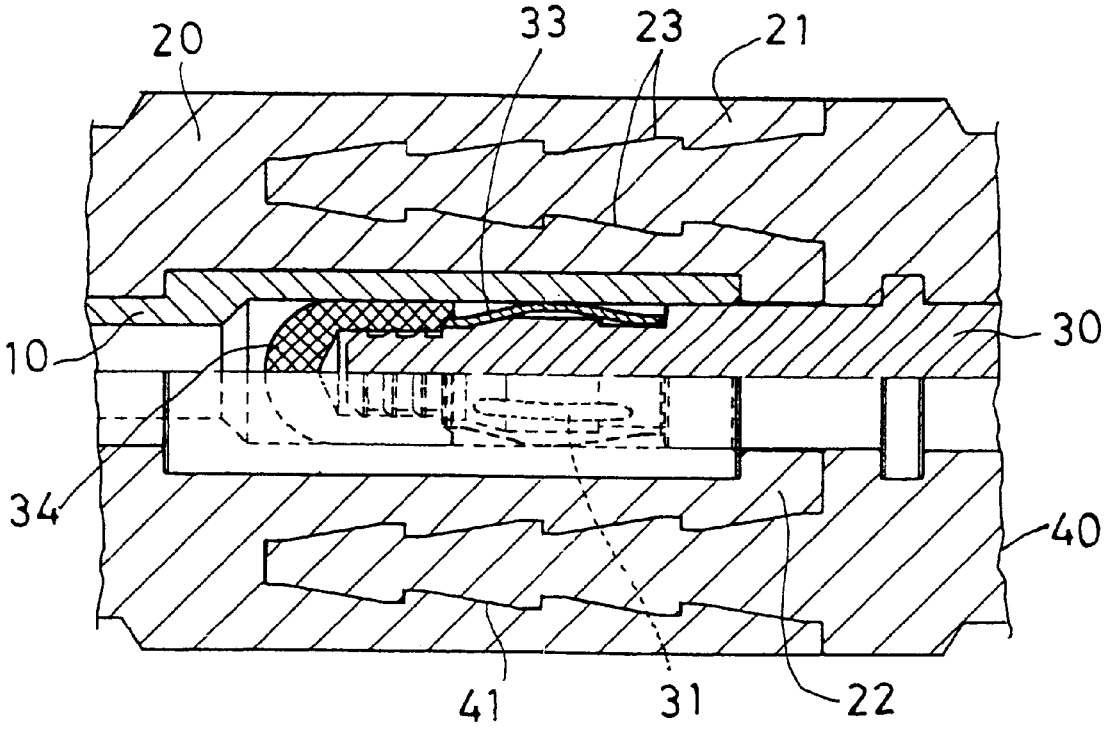
FIG. 4 is a partial enlarged view of FIG. 1.
Figure 5A:
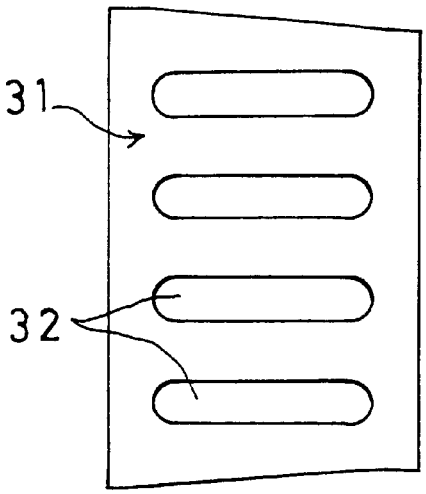
FIGS. 5A and 5B are views showing how a contact member for the male terminal is formed.
Figure 5B:
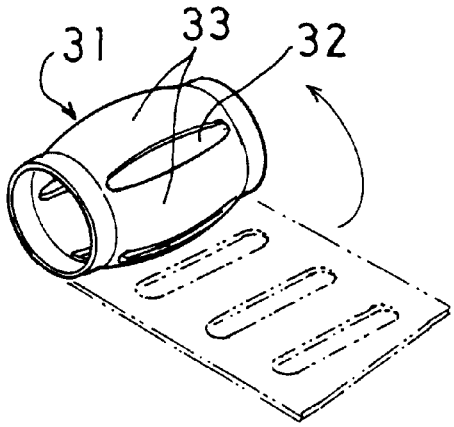

A potbelly-shaped contact member 31 is fitted on a portion of the male terminal 30 near its tip. The contact member 31 is formed by rolling a spring plate formed with slits 32 at equal intervals (FIG. 5A) into the shape of a potbelly (FIG. 5B) so that portions 33 between the slits 32 are arcuately curved outwardly (i.e., convexed). When the male terminal 30 is inserted into the female terminal 10 as shown in FIGS. 1 and 4, the outwardly convexed portions 33 are brought into close contact with the inner wall of the female terminal 10, so that the terminals 10 and 30 are electrically coupled together with high contact pressure.

An insulating cap 34 made of a hard nonconductive resin is put on the tip of the male terminal 30 to prevent short-circuiting due to inadvertent contact with an electrically conductive material.

The female housing 20 has outer and inner tubular portions 21 and 22 having axially corrugated inner and outer surfaces 23, respectively, defining an annular deep groove therebetween.

The male housing 40 has an annular tip having axially corrugated inner and outer surfaces 41. When the annular tip of the male housing 40 is inserted into the annular groove of the female housing 20 as shown in FIGS. 1 and 4, the corrugated surfaces 41 of the male housing 40 engage the corrugated surfaces 23 of the female housing 20, thus strongly coupling the housings 20 and 40 together.

Figure 6:
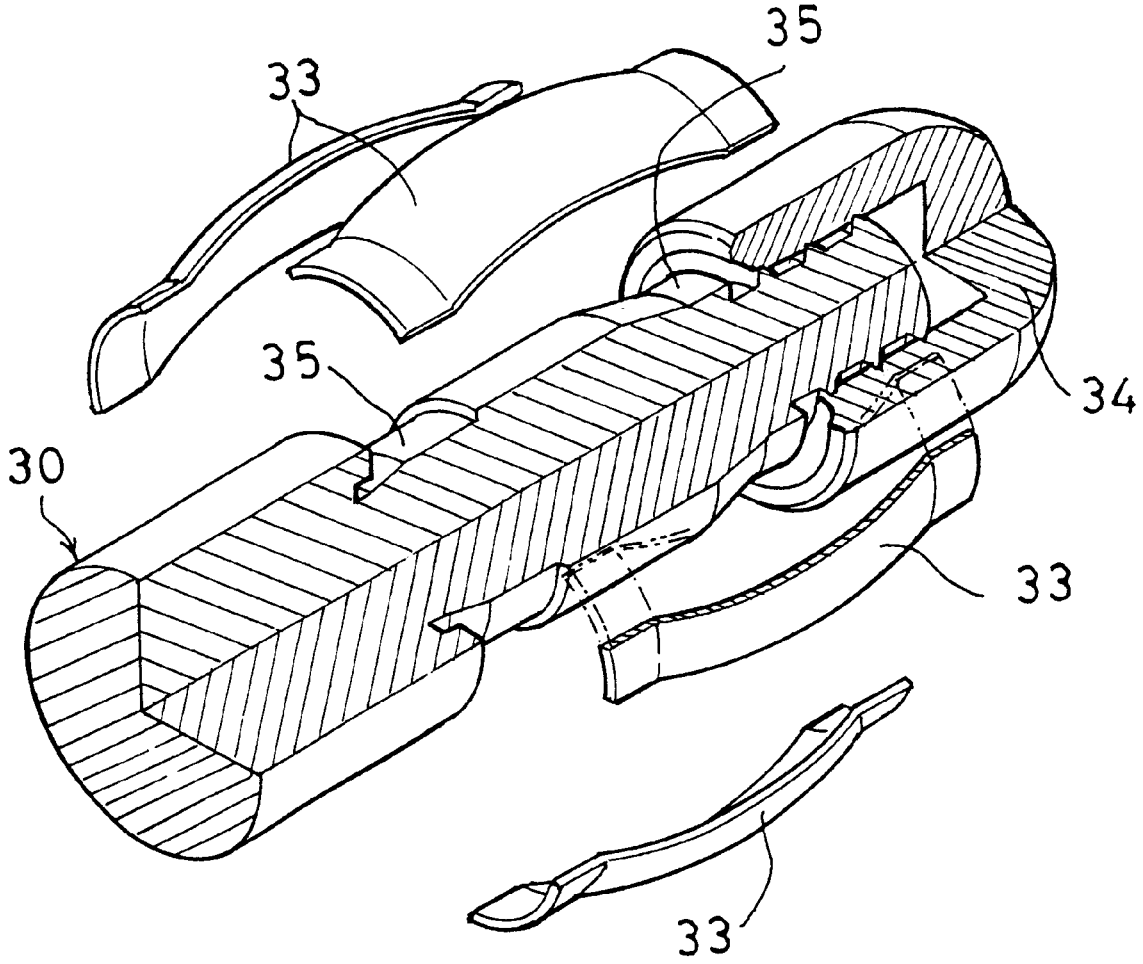
FIG. 6 is a partially cutaway exploded perspective view of a second embodiment.

FIG. 6 shows a second embodiment. The contact member 33 of this embodiment comprises a plurality of separate contact pieces having both ends received in grooves 35 formed in the male terminal 30 so as to be bent arcuately outwardly except their straight ends. But the ends may be not straight but be arcuate and continuous with the central portion. This is true for the first embodiment, too.

Figure 7:
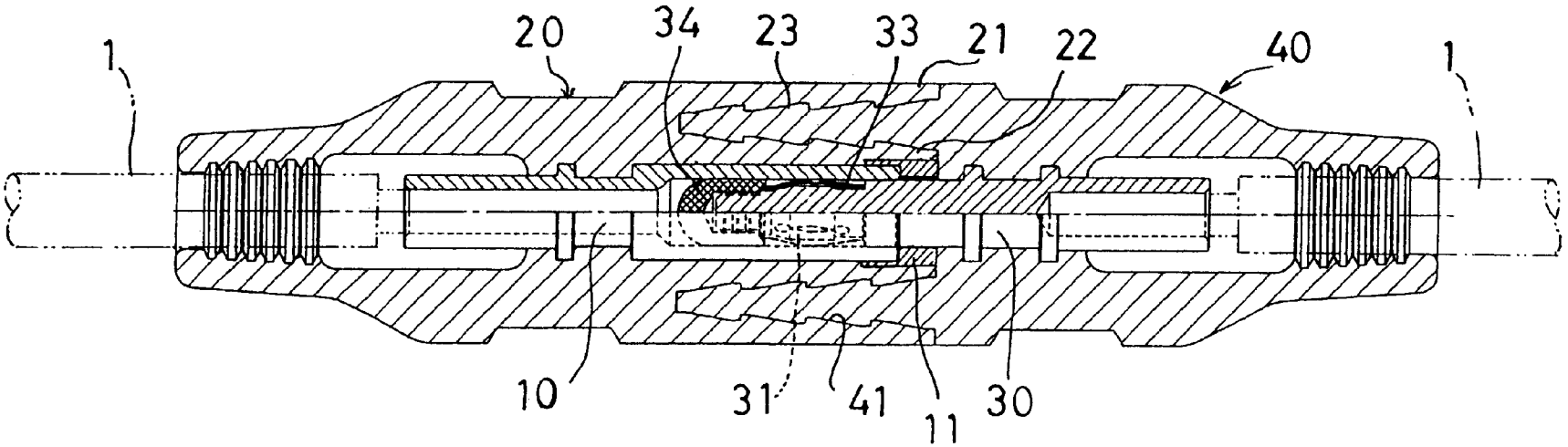
FIG. 7 is a sectional view of a third embodiment.
Figure 8:
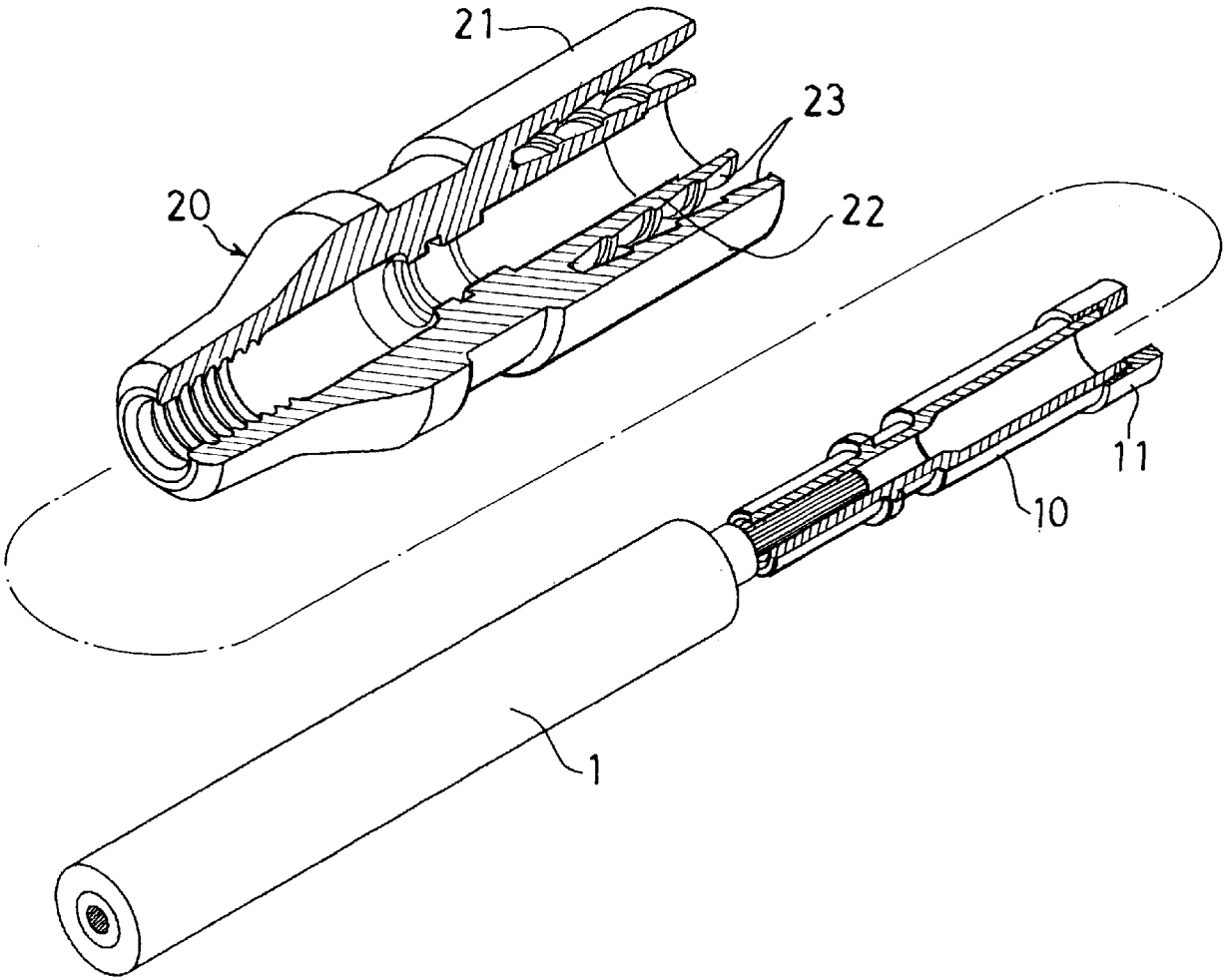
FIG. 8 is a partially cutaway perspective view of a portion of a female terminal of the embodiment of FIG. 7.

FIGS. 7 and 8 show a third embodiment in which an insulating cap 11 made of a hard resin is put on the tip of the female terminal 10, too. The cap 11 keeps the tip of the female terminal 10 insulated even if the female housing 20 has its tip peeled.

Figure 9A:
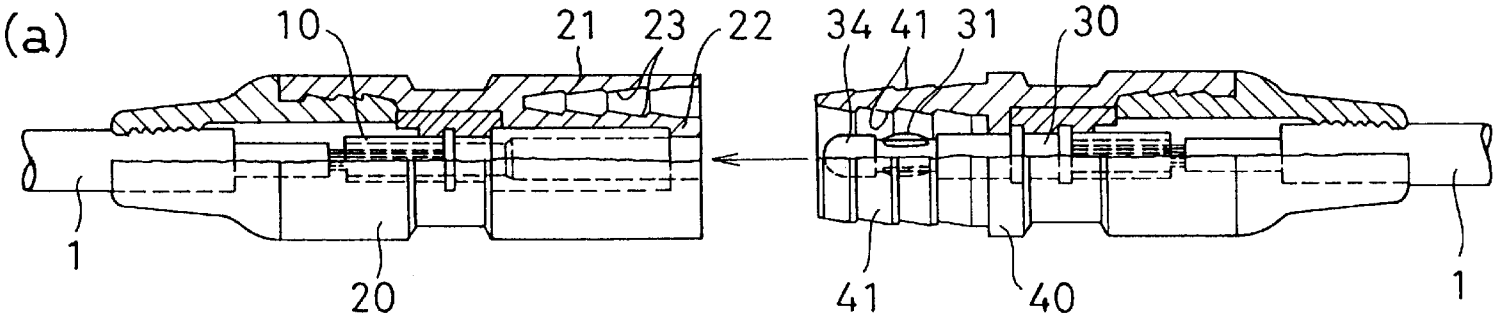
FIGS. 9A and 9B are a partially cutaway front view and a plan view of a fourth embodiment.
Figure 9B:
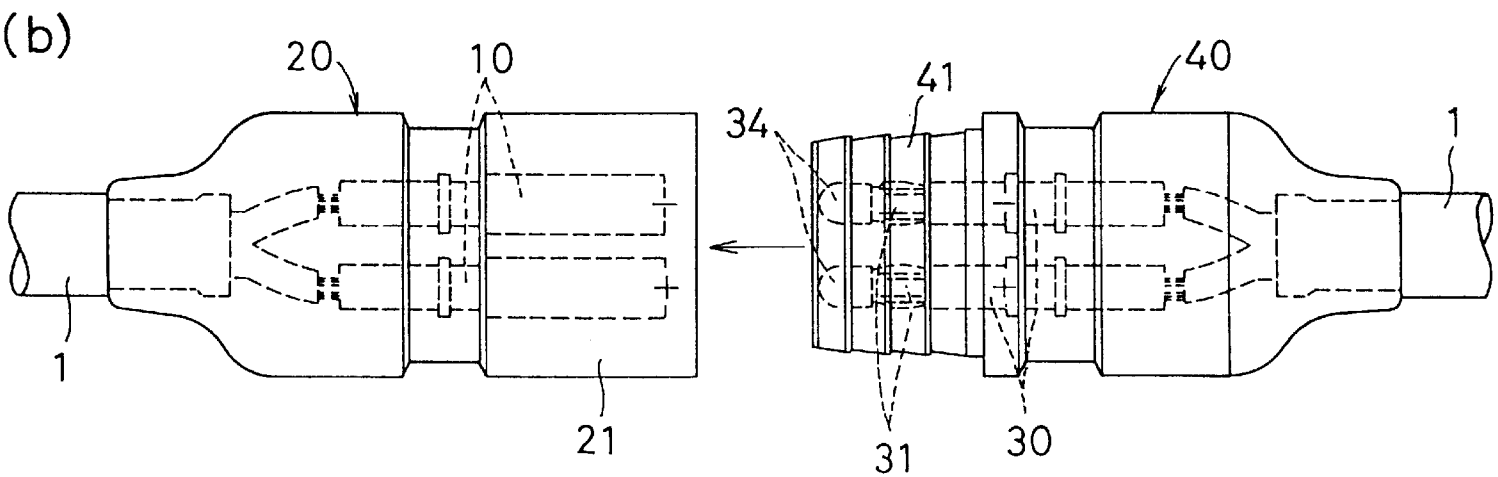

Although single-core connectors are shown as embodiments, the present invention is applicable to connectors with a plurality of cores such as a double-core connector as shown in FIGS. 9A and 9B.

The connector according to the invention can strongly connect two lines together and be useful as a connector for power connection in a solar generator.

What is claimed is:

1. An electrical connector assembly for use in a solar generator, comprising:

a first tubular insulating resin housing comprising an outer tubular portion comprising a first axially corrugated outer surface, said first axially corrugated outer surface having a first outer shape, and an inner tubular portion comprising a first axially corrugated inner surface, said first axially corrugated inner surface having a first inner shape, wherein said first axially corrugated outer surface and said first axially corrugated inner surface are annular and are spaced from one another so as to provide an annular groove in said first tubular insulating resin housing, wherein said annular groove has a first axial end, a second axial end, an axial depth, and a radial width that varies as a function of said axial depth; and wherein the radial width of said first end of the annular groove is greater than the radial width of said second end of said annular groove;

a second tubular insulating resin housing comprising an annular tip, said annular tip being adapted to be inserted into said annular groove, said annular tip comprising a second axially corrugated outer surface, said second axially corrugated outer surface having a second outer shape, and a second axially corrugated inner surface, said second axially corrugated inner surface having a second inner shape, wherein said first outer shape and said second outer shape are complementary with each other, and wherein said first inner shape and said second inner shape are complementary with each other;

a first terminal located in said first tubular insulating resin housing; and a second terminal located in said second tubular insulating resin housing, said second terminal being adapted to contact said first terminal when said annular tip is inserted into said annular groove.

2. The electrical connector assembly of claim 1, wherein said first terminal is rod-shaped.

3. The electrical connector assembly of claim 1, wherein said first terminal is coaxial with said first tubular insulating resin housing.

4. The electrical connector assembly of claim 1, further comprising a first insulating resin member;

wherein said first terminal comprises a first tip;

wherein said first tip is covered by said first insulating resin member;

wherein said first tubular insulating resin housing and said second tubular insulating resin housing comprise a first resin, said first resin having a first hardness; and wherein said first insulating resin member comprise a second resin, said second resin having a second hardness that is greater than said first hardness.

5. The electrical connector assembly of claim 4, further comprising a second insulating resin member comprising said second resin;

wherein said second terminal comprises a second tip; and wherein said second tip is covered by said second insulating resin member.

6. She electrical connector assembly of claim 1, wherein said first terminal is a female terminal, wherein said second terminal is a male terminal, and wherein said male terminal is adapted to insert into said female terminal when said annular tip is inserted into said annular groove.

7. The electrical connector assembly of claim 1, wherein said first corrugated outer surface comprises a plurality of corrugations, wherein each corrugation of said plurality of corrugations comprises:

a first surface that is substantially perpendicular to said axial depth of said annular groove; and a second surface that is not parallel with said axial depth of said annular groove.

8. An electrical connector assembly for use in a solar generator, comprising:

a first tubular insulating resin housing comprising an outer tubular portion comprising a first axially corrugated outer surface, said first axially corrugated outer surface having a first outer shape, said first axially corrugated outer surface comprising a first plurality of similar outer corrugations spaced apart at an interval, and an inner tubular portion comprising a first axially corrugated inner surface, said first axially corrugated inner surface having a first inner shape, said first axially corrugated inner surface comprising a first plurality of similar inner corrugations spaced apart at the interval, said first plurality of similar inner corrugations being axially aligned with said first plurality of similar outer corrugations, wherein said first axially corrugated inner surface and said first axially corrugated outer surface are annular and are spaced from one another so as to provide an annular groove in said first tubular insulating resin housing;

a second tubular insulating resin housing comprising an annular tip, said annular tip being adapted to be inserted into said annular groove of said first tubular insulating resin housing, said annular tip comprising a second axially corrugated outer surface having a second outer shape, said second axially corrugated outer surface comprising a second plurality of similar outer corrugations spaced apart at the interval, and a second axially corrugated inner surface having a second inner shape, said second axially corrugated inner surface comprising a second plurality of similar inner corrugations spaced apart at the interval;

a first terminal located in said first tubular insulating resin housing; and a second terminal located in said second tubular insulating resin housing, said second terminal adapted to contact said first terminal when said annular tip is inserted into said annular groove;

wherein said first outer shape and said second outer shape are complementary to each other; and wherein said first inner shape and said second inner shape are complementary to each other.

9. The electrical connector assembly of claim 8, wherein said first terminal is rod shaped.

10. The electrical connector assembly of claim 8, wherein said first terminal is coaxial with said first tubular insulating resin housing.

11. The electrical connector assembly of claim 8, further comprising:

a first insulating resin member;

wherein said first terminal comprises a first tip;

wherein said first tip is covered by said first insulating resin member;

wherein said first tubular insulating resin housing and said second tubular insulating resin housing comprise a first resin, said first resin having a first hardness; and wherein said first insulating resin member comprise a second resin, said second resin having a second hardness that is greater than said first hardness.

12. The electrical connector assembly of claim 11, further comprising a second insulating resin member comprising said second resin;

wherein said second terminal comprises a second tip; and wherein said second tip is covered by said second insulating resin member.

13. The electrical connector assembly of claim 8, wherein said first terminal is a female terminal, wherein said second terminal is a male terminal, and wherein said male terminal is adapted to insert into said female terminal when said annular tip is inserted into said annular groove.

14. The electrical connector assembly of claim 8, wherein each corrugation of said first plurality of similar outer corrugations comprises:

a first surface that is substantially perpendicular to said axial depth of said annular groove, and a second surface that is not parallel with said axial depth of said annular groove.

15. An electrical connector assembly for use in a solar generator, comprising:

a first tubular insulating resin housing comprising an outer tubular portion comprising a first axially corrugated outer surface, said first axially corrugated outer surface having a first outer shape, and an inner tubular portion comprising a first axially corrugated inner surface, said first axially corrugated inner surface having a first inner shape, wherein said first axially corrugated outer surface and said first axially corrugated inner surface are annular and are spaced from one another so as to provide an annular groove in said first tubular insulating resin housing, wherein said annular groove has a first axial end, a second axial end, an axial depth, and a radial width that varies as a function of said axial depth; and wherein the radial width of said first end of the annular groove is greater than the radial width of said second end of said annular groove;

a second tubular insulating resin housing adapted to be connected with said first tubular insulating resin housing, said second tubular insulating resin housing comprising an annular tip, said annular tip being adapted to be inserted into said annular groove when second tubular insulating resin housing is connected with said first tubular insulating resin housing, said annular tip comprises a second axially corrugated outer surface, said second axially corrugated outer surface having a second outer shape, and a second axially corrugated inner surface, said second axially corrugated inner surface having a second inner shape, wherein said first outer shape and said second outer shape are complementary with each other, and wherein said first inner shape and said second inner shape are complementary with each other;

an insulating resin member, a female terminal having an inner wall and an outer wall, said female terminal located in said first housing;

a male terminal located in said second housing, said male terminal adapted to be inserted into said female terminal so as to be electrically connected to said female terminal, said male terminal having a tip, said tip of said male terminal being covered by said insulating resin member; and a radially outwardly convexed annular contact member comprising a plurality of radially outwardly convexed separate pieces, said contact member being arranged over the circumference of said male terminal so as to be pressed into close contact with said inner wall of said female terminal so as to establish an electrical connection between said male terminal and said female terminal when said male terminal is inserted into said female terminal.

16. The electrical connector assembly of claim 15, wherein said first terminal is rod shaped.

17. The electrical connector assembly of claim 15, wherein said first terminal is coaxial with said first tubular insulating resin housing.

18. The electrical connector assembly of claim 15, wherein said first tubular insulating resin housing and said second tubular insulating resin housing comprise a first resin, said first resin having a first hardness, and wherein said insulating resin member comprises a second resin, said second resin having a second hardness that is greater than said first hardness.

19. The electrical connector assembly of claim 15, wherein said second housing further comprises a first receiving groove, and a second receiving groove, wherein each of said plurality of radially outwardly convexed separate pieces further comprises a first straight end received into said first receiving groove, and a second straight end received into said second receiving groove.

20. An electrical connector assembly for use in a solar generator, comprising:

a first tubular insulating resin housing comprising an outer tubular portion comprising a first axially corrugated outer surface, said first axially corrugated outer surface comprising a first plurality of similar outer corrugations spaced apart at an interval, and an inner tubular portion comprising a first axially corrugated inner surface, said first axially corrugated inner surface comprising a first plurality of similar inner corrugations spaced apart at the interval, said first plurality of similar inner corrugations being axially aligned with said first plurality of similar outer corrugations, wherein said first axially corrugated inner surface and said first axially corrugated outer surface are annular and are spaced from one another so as to provide an annular groove in said first tubular insulating resin housing;

a second tubular insulating resin housing adapted to be connected with said first tubular insulating resin housing, said second tubular insulating resin housing comprising an annular tip, said annular tip being adapted to be inserted into said annular groove when second tubular insulating resin housing is connected with said first tubular insulating resin housing, said annular tip comprises a second axially corrugated outer surface, said second axially corrugated outer surface comprising a second plurality of similar outer corrugations spaced apart at the interval, and a second axially corrugated inner surface, said second axially corrugated inner surface comprising a second plurality of similar inner corrugations spaced apart at the interval, wherein said first plurality of similar outer corrugations and said second plurality of similar outer corrugations have complementary shapes, and wherein said first plurality of similar inner corrugations and said second plurality of similar inner corrugations have complementary shapes;

an insulating resin member;

a female terminal having an inner wall and an outer wall, said female terminal located in said first housing;

a male terminal located in said second housing, said male terminal adapted to be inserted into said female terminal so as to be electrically connected to said female terminal, said male terminal having a tip, said tip of said male terminal being covered by said insulating resin member; and a radially outwardly convexed annular contact member comprising a plurality of radially outwardly convexed separate pieces, said contact member being arranged over the circumference of said male terminal so as to be pressed into close contact with said inner wall of said female terminal so as to establish an electrical connection between said male terminal and said female terminal when said male terminal is inserted into said female terminal.

21. The electrical connector assembly of claim 20, wherein said first terminal is rod-shaped.

22. The electrical connector assembly of claim 20, wherein said first terminal is coaxial with said first tubular insulating resin housing.

23. The electrical connector assembly of claim 20, wherein said first tubular insulating resin housing and said second tubular insulating resin housing comprise a first resin, said first resin having a first hardness; and wherein said insulating resin member comprises a second resin, said second resin having a second hardness that is greater than said first hardness.

24. The electrical connector assembly of claim 20, wherein said second housing further comprises a first receiving groove, and a second receiving groove, wherein each of said plurality of radially outwardly convexed separate pieces further comprises a first straight end received into said first receiving groove, and a second straight end received into said second receiving groove.

* * * * *